US008983818B2

(12) United States Patent
Fourno et al.

(10) Patent No.: US 8,983,818 B2
(45) Date of Patent: Mar. 17, 2015

(54) METHOD FOR CHARACTERIZING THE FRACTURE NETWORK OF A FRACTURED RESERVOIR AND METHOD FOR DEVELOPING IT

(75) Inventors: André Fourno, Rueil-Malmaison (FR); Bernard Bourbiaux, Rueil Malmaison (FR)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 468 days.

(21) Appl. No.: 13/288,049

(22) Filed: Nov. 3, 2011

(65) Prior Publication Data

US 2012/0116740 A1 May 10, 2012

(30) Foreign Application Priority Data

Nov. 10, 2010 (FR) ..... 10 04398

(51) Int. Cl.

| | |
|---|---|
| ***G06G 7/48*** | (2006.01) |
| ***E21B 49/00*** | (2006.01) |
| ***E21B 43/00*** | (2006.01) |
| ***E21B 43/26*** | (2006.01) |

(52) U.S. Cl.

CPC ..... *E21B 49/00* (2013.01); *E21B 49/008* (2013.01); *E21B 43/00* (2013.01); *E21B 43/26* (2013.01)

USPC ..... 703/10

(58) Field of Classification Search

None

See application file for complete search history.

(56) References Cited

U.S. PATENT DOCUMENTS

| | | | | |
|---|---|---|---|---|
| 5,619,945 | A * | 4/1997 | Nedderman et al. | 114/67 A |
| 5,659,135 | A | 8/1997 | Cacas | |
| 6,023,656 | A | 2/2000 | Cacas et al. | |
| 6,064,944 | A | 5/2000 | Sarda et al. | |
| 6,842,725 | B1 | 1/2005 | Sarda | |

(Continued)

FOREIGN PATENT DOCUMENTS

| | | |
|---|---|---|
| EP | 2 037 080 A1 | 3/2009 |
| FR | 2 733 073 | 10/1996 |

(Continued)

OTHER PUBLICATIONS

Warren, J.E., et al: "The Behavior of Naturally Fractured Reservoirs" , SPE Papers, vol. 3, No. 3, Sep. 1, 1963, pp. 245-255, XP002058945.

Basquet, R. et al: Fracture Flow Property Idnetification: An Optimized Implementation of Discrete Fracture Network Models, SPE Proceedings, vol. SPE, No. 93748, Mar. 12, 2005, pp. 1-9, XP002472554.

(Continued)

*Primary Examiner* — Omar Fernandez Rivas
*Assistant Examiner* — Bernard E Cothran
(74) *Attorney, Agent, or Firm* — Antonelli, Terry, Stout & Kraus, LLP.

(57) ABSTRACT

The invention is a method for constructing a representation of a fluid reservoir traversed by a fracture network and by at least one well. The reservoir is discretized into a set of grid cells and the fractures are characterized by statistical parameters from observations of the reservoir. An equivalent permeability tensor and an average fracture opening is constructed from an image representative of the fracture network delimiting porous blocks and fractures is then deduced from the statistical parameters. A first elliptical boundary zone centered on the well and at least a second elliptical boundary zone centered on the well which form an elliptical ring with the elliptical boundary of the first zone are defined around the well. The image representative of the fracture network is simplified in a different manner for each of the zones which is used to construct the representation of the fluid reservoir.

31 Claims, 4 Drawing Sheets

(56) References Cited

U.S. PATENT DOCUMENTS

| | | | | |
|---|---|---|---|---|
| 2002/0016702 | A1* | 2/2002 | Manceau et al. | 703/10 |
| 2008/0091396 | A1 | 4/2008 | Kennon et al. | |
| 2009/0005996 | A1 | 1/2009 | Delorme et al. | |
| 2009/0164189 | A1* | 6/2009 | Bourbiaux | 703/10 |
| 2010/0204972 | A1 | 8/2010 | Hsu et al. | |
| 2010/0274547 | A1 | 10/2010 | Bourbiaux et al. | |
| 2010/0307755 | A1* | 12/2010 | Xu et al. | 166/308.1 |

FOREIGN PATENT DOCUMENTS

| | | |
|---|---|---|
| FR | 2 757 947 | 7/1998 |
| FR | 2 757 957 | 7/1998 |
| FR | 2 787 219 | 6/2000 |
| FR | 2 923 930 | 5/2009 |

OTHER PUBLICATIONS

Famy, C., et al: "Accurate Modeling of Matrix-Fracture Transfers in Dual-Porosity Models: Optimal Subgridding of Matrix Block", Proceedings of the SPE Reservoir Simulation Symposium, Houston, Texas, USA, No. 93115, Jan. 1, 2005, pp. 257-267, XP002487219.

Bourbiaux, B., et al: "A Rapid and Efficient Methodology to Convert Fractured Reservoir Images into a Dual-Porosity Model", Oil & Gas Science and Technology, vol. 53, No. 6, Nov.-Dec. 1998, pp. 785-799.

Delorme, M., et al: "Upscaling Improvement for Heterogeneous Fractured Reservoir Using a Geostatistical Connectivity Index", (10 pages) Geostatistics 2008, VIII International Geostatisics Congress, Santiago, Chile.

* cited by examiner $(a,b)\ \#(s1_{fin}, s2_{fin})$ $(a,b)\#(s1_{gros}, s2_{gros})$

METHOD FOR CHARACTERIZING THE FRACTURE NETWORK OF A FRACTURED RESERVOIR AND METHOD FOR DEVELOPING IT

BACKGROUND OF THE INVENTION

1. Field of the Invention

The present invention relates to development of underground reservoirs, such as hydrocarbon reservoirs comprising a fracture network. In particular, the invention relates to a method for characterizing the fracture network and constructing a representation of the reservoir. The representation is used to optimize the management of development through a prediction of the fluid flows likely to occur through the medium to simulate hydrocarbon production according to various production scenarios.

2. Description of the Prior Art

The petroleum industry, and more precisely exploration and development of reservoirs, notably petroleum reservoirs, require knowledge of the underground geology which is as perfect as possible so as to efficiently provide evaluation of reserves, production modelling or development management. In fact, determining the location of a production well or of an injection well, the drilling mud composition, the completion characteristics, selection of a hydrocarbon recovery method (such as waterflooding for example) and of the parameters required for implementing this method (such as injection pressure, production flow rate, etc.) requires good knowledge of the reservoir. Reservoir knowledge notably means knowledge of the petrophysical properties of the subsoil at any point in space.

The petroleum industry has therefore combined for a long time field (in-situ) measurements with experimental modelling (performed in the laboratory) and/or numerical modelling (using softwares). Petroleum reservoir modelling is a technical stage that is essential for any reservoir exploration or development procedure. The goal of modelling is to provide a description of the reservoir.

Fractured reservoirs are an extreme type of heterogeneous reservoirs comprising two very different media, a matrix medium containing the major part of the oil in place and having a low permeability, and a fractured medium representing less than 1% of the oil in place and highly conductive. The fractured medium itself can be complex, with different sets of fractures characterized by their respective density, length, orientation, inclination and opening.

Those in charge of the development of fractured reservoirs need to perfectly know the role of fractures. What is referred to as a "fracture" is a plane discontinuity of very small thickness in relation to the extent thereof, representing a rupture plane of a rock of the reservoir. On the one hand, knowledge of the distribution and of the behavior of these fractures allows optimizing the location and the spacing between wells to be drilled through the oil-bearing reservoir. On the other hand, the geometry of the fracture network conditions the fluid displacement, on the reservoir scale as well as the local scale where it determines elementary matrix blocks in which the oil is trapped. Knowing the distribution of the fractures is therefore also very helpful at a later stage to the reservoir engineer who wants to calibrate the models which have been constructed to simulate the reservoirs in order to reproduce or to predict the past or future production curves. Geosciences specialists therefore have three-dimensional images of reservoirs allowing locating a large number of fractures.

Thus, in order to reproduce or to predict (that is "simulate") the production of hydrocarbons when starting production of a reservoir according to a given production scenario (characterized by the position of the wells, the recovery method, etc.), reservoir engineers use a computing software referred to as reservoir simulator (or flow simulator) that calculates the flows and the evolution of the pressures within the reservoir represented by the reservoir model. The results of these computations enable prediction and optimization of the reservoir in terms of flow rate and/or of amount of hydrocarbons recovered. Calculation of the reservoir behavior according to a given production scenario constitutes a "reservoir simulation".

There is a well-known method for optimizing the development of a fluid reservoir traversed by a fracture network, wherein fluid flows through the reservoir are simulated through simplified but realistic modelling of the reservoir. This simplified representation is referred to as "double-medium approach", described by Warren J. E. et al. in "The Behavior of Naturally Fractured Reservoirs", SPE Journal (September 1963), 245-255. This technique considers the fractured medium as two continua exchanging fluids with one another: matrix blocks and fractures which is referred to as a "double medium" or "double porosity" model. Thus, "double-medium" modelling of a fractured reservoir discretizes the reservoir into two superposed sets of cells (referred to as grids) making up the "fracture" grid and the "matrix" grid. Each elementary volume of the fractured reservoir is thus conceptually represented by two cells, a "fracture" cell and a "matrix" cell, coupled to one another (i.e. exchanging fluids). In the reality of the fractured field, these two cells represent all of the matrix blocks delimited by fractures present at this point of the reservoir. In fact, in most cases, the cells have hectometric lateral dimensions (commonly 100 or 200 m) considering the size of the fields and the limited possibilities of simulation softwares in terms of computing capacity and time. The result thereof is that, for most fractured fields, the fractured reservoir elementary volume (cell) comprises innumerable fractures forming a complex network that delimits multiple matrix blocks of variable dimensions and shapes according to the geological context. Each constituent real block exchanges fluids with the surrounding fractures at a rate (flow rate) that is specific thereto because it depends on the dimensions and on the shape of this particular block.

In the face of such a geometrical complexity of the real medium, the approach is for each reservoir elementary volume (cell), in representing the real fractured medium as a set of matrix blocks that are all identical, parallelepipedic, delimited by an orthogonal and regular network of fractures oriented in the principal directions of flow: For each cell, the so-called "equivalent" permeabilities of this fracture network are thus determined and a matrix block referred to as "representative" (of the real (geological) distribution of the blocks), single and of parallelepipedic shape, is defined. It is then possible to formulate and to calculate the matrix-fracture exchange flows for this "representative" block and to multiply the result by the number of such blocks in the elementary volume (cell) to obtain the flow on the scale of this cell.

It can however be noted that calculation of the equivalent permeabilities requires knowledge of the flow properties (that is the conductivities) of the discrete fractures of the geological model.

It is therefore necessary, prior to constructing this equivalent reservoir model (referred to as "double-medium reservoir model") as described above, to simulate the flow responses of some wells (transient or pseudo-permanent flow tests, interferences, flow measurement, etc.) on models extracted from the geological model giving a discrete (realistic) representation of the fractures supplying these wells. Adjustment of the simulated pressure/flow rate responses on the field measurements allows the conductivities of the fracture families to be calibrated. Although it covers a limited area (drainage area) around the well only, such a well test simulation model still comprises a very large number of calculation nodes if the fracture network is dense. Consequently, the size of the systems to be solved and/or the computation time often remain prohibitive.

SUMMARY OF THE INVENTION

To overcome this difficulty, the invention comprises a simplification of the fracture networks on the local scale of the well drainage area, so as to be able to simulate the fractured reservoir well tests and thus to calibrate the conductivities of the fracture families. This hydraulic calibration of the fractures leads to a set of parameters characterizing the fracture network (or fracture model). This fracture model is thereafter used to construct a double-medium flow model on the reservoir scale.

The invention thus relates to a method for optimizing the development of a fluid reservoir traversed by a fracture network and by at least one well, wherein a representation of the fluid reservoir is constructed. The reservoir is discretized into a set of cells and the fractures are characterized by statistical parameters (PSF) from observations of the reservoir. The method comprises the following stages:

a) deducing from the statistical parameters (PSF) an equivalent permeability tensor and an average opening for the fractures, from which an image representative of the fracture network delimiting porous blocks and fractures is constructed;
b) deducing from the tensor a direction of flow of the fluid around the well;
c) defining around the well a first elliptical boundary zone centered on the well and containing the well, and at least a second elliptical boundary zone centered on the well and forming an elliptical ring with the elliptical boundary of the first zone, the zones being oriented in the direction of flow of the fluid;
d) simplifying the image representative of the fracture network in a different manner in each one of the zones;
e) using the simplified image to construct the representation of the fluid reservoir; and
f) using the representation of the fluid reservoir and a flow simulator to optimize the development of the fluid reservoir.

According to the invention, the statistical parameters (PSF) can be selected from among the following parameters: fracture density, fracture length, fracture orientation, fracture inclination, fracture opening and fracture distribution within the reservoir.

According to an embodiment, an aspect ratio is determined for each zone, defined from the lengths of the axes of the ellipse making up the boundary of the zone, so as to reproduce a flow anisotropy around the well, and the zones are constructed so as to respect the aspect ratio. This aspect ratio can be determined by the principal values of the permeability tensor.

According to an embodiment, a distance is defined between the boundaries between zones, so as to give an equal weight to each zone in terms of pressure difference recorded in each zone under permanent flow regime conditions. This distance can be defined by setting the lengths of one of the two axes of two successive ellipsis at values in geometric progression of constant ratio.

According to another embodiment, three zones are constructed, a first zone (ZNS) containing the well, wherein no image simplification is provided, a second zone (ZP) in contact with the first zone, wherein a first image simplification is carried out, and a third zone (ZL) in contact with the second zone, wherein a second image simplification is carried out with the second simplification being more significant than the first one.

Advantageously, the second and third zones can be divided into sub-zones by applying the following stages:

the second zone is divided into a number of sub-zones equal to a number of blocks of cells present in the zone with a block of cells designating a vertical pile of cells; the third zone is divided by carrying out the following stages:

- dividing every degree of the boundary of the third zone into 360 arcs;
- defining a sub-zone by connecting end points of each of the arcs to the center of the ellipse forming the boundary;
- for each one of the sub-zones, calculating an equivalent fracture permeability tensor from which an orientation of the flows in the sub-zone is determined;
- comparing the equivalent fracture permeability values and the flow orientation between neighboring sub-zones; and
- grouping neighboring sub-zones together into a single sub-zone when a difference between the permeability values is below a first threshold and when a difference between the flow orientations is below a second threshold.

According to the invention, the image can be simplified by carrying out the following stages:

- constructing a fracture network equivalent of the image (RFE), by means of a so-called Warren and Root representation, wherein the network is characterized by fracture spacings ($s_1^{fin}$, $s_2^{fin}$) in two orthogonal directions of principal permeability, by a fracture opening parameter ($e^{fin}$), by fracture conductivities ($C_{f1}^{fin}$ and $C_{f2}^{fin}$) and a permeability ($k_m^{fin}$) of a matrix medium between fractures; and
- simplifying the equivalent fracture network (RFE) by a network fracture spacing coefficient (G) whose value is less than a value $G_{max\text{-}zone}$ defined on each of the zones in order to guarantee sufficient connectivity between simplified zones and non-simplified zones.

Value $G_{max\text{-}zone}$ can be defined as follows for a given sub-zone:

$$G_{max-zone} = \frac{DLM}{6 \cdot \mathrm{Max}(s_1^{fin}, s_2^{fin})}$$

with:

DLM: minimum lateral dimension of the given sub-zone;

$s_1^{fin}$, $s_2^{fin}$: fracture spacings in the so-called Warren and Root representation.

Finally, the invention also relates to a method for optimizing the management of a reservoir. It comprises the following stages:

- repeating stage a) while modifying the statistical parameters (PSF) so as to minimize a difference between a well test result and a well test simulation result from the simplified image;
- associating with each one of the cells at least one equivalent permeability value and an average opening value for the fractures with the values being determined from the modified statistical parameters (PSF);

simulating fluid flows in the reservoir with a flow simulator, and the equivalent permeability values and the average opening values of the fractures associated with each one of the cells;

selecting a production scenario allowing optimizing the reservoir production with the fluid flow simulation; and developing the reservoir according to the scenario allowing optimizing the reservoir production.

BRIEF DESCRIPTION OF THE DRAWINGS

Other features and advantages of the method according to the invention will be clear from reading the description hereafter of embodiments given by way of non limitative example, with reference to the accompanying figures wherein.

DETAILED DESCRIPTION OF THE INVENTION

Figure 1:
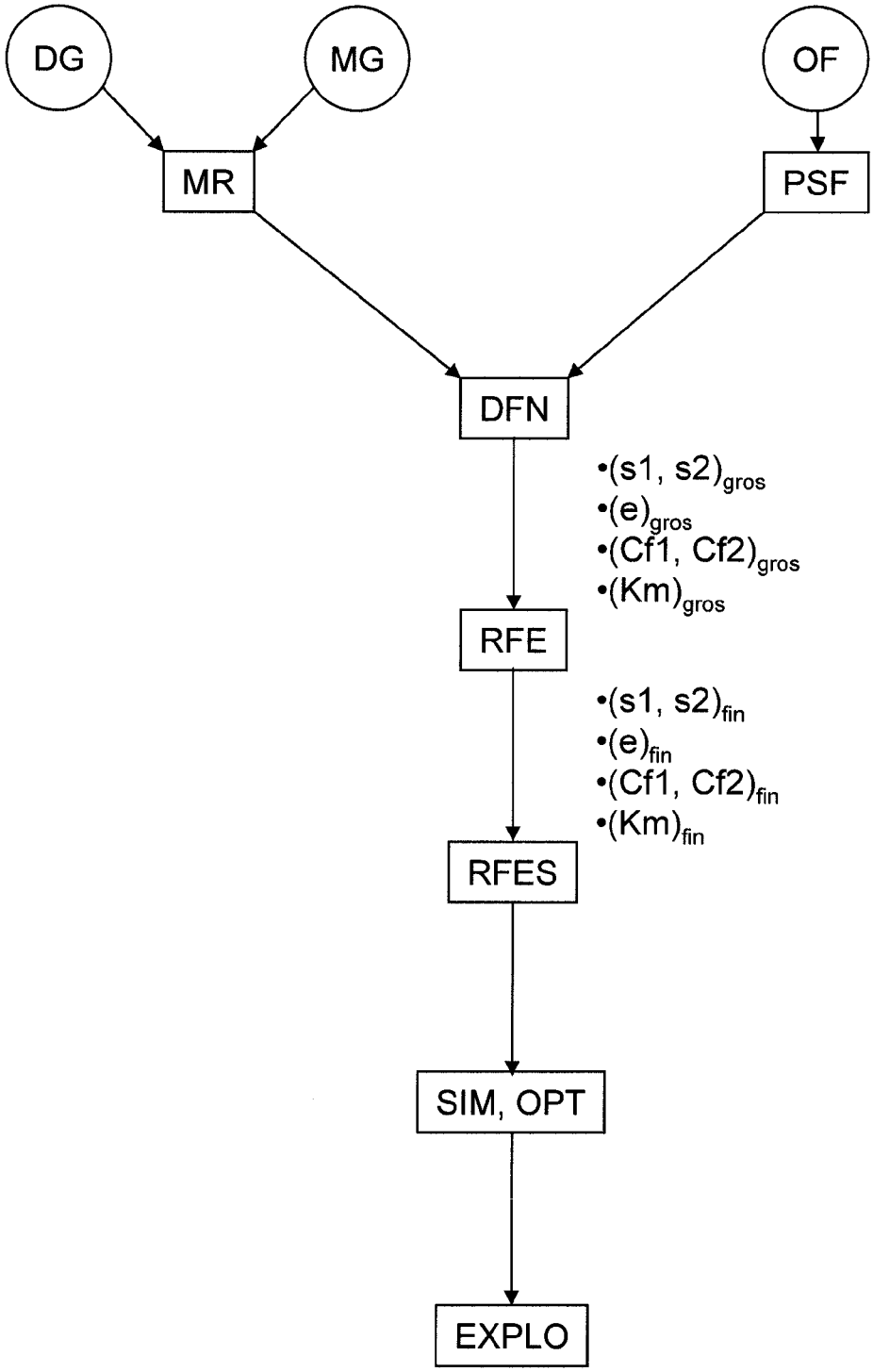
FIG. 1 illustrates the various stages of the method according to the invention.

The method according to the invention for optimizing the development of a reservoir using the method of the invention for characterizing the fracture network comprises four stages, as illustrated in FIG. 1:

1—Discretization of the reservoir into a set of cells (MR)

2—Modelling of the fracture network (DFN, RFE, RFES)

3—Simulation of the fluid flows (SIM) and optimization of the reservoir production conditions (OPT)

4—Optimized (global) development of the reservoir (EXPLO)

1—Discretization of the Reservoir into a Set of Cells (MR)

The petroleum industry has combined for a long time field (in-situ) measurements with experimental modelling (performed in the laboratory) and/or numerical modelling (using softwares). Petroleum reservoir modelling thus is an essential technical stage with a view to reservoir exploration or development. The goal of such modelling is to provide a description of the reservoir, characterized by the structure/geometry and the petrophysical properties of the geological deposits or formations therein.

These modellings are based on a representation of the reservoir as a set of cells. Each cell represents a given volume of the reservoir and makes up an elementary volume of the reservoir. The cells in their entirety make up a discrete representation of the reservoir which is referred to as geological model.

Many software tools are known allowing construction of such reservoir models from data (DG) and measurements (MG) relative to the reservoir.

Figure 2:
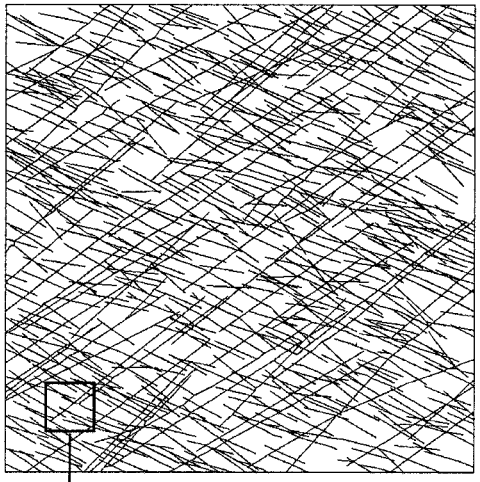
FIG. 2 illustrates a realization of a fracture/fault network on the reservoir scale.

FIG. 2 illustrates a two-dimensional view of a reservoir model. The fractures are represented by lines. The cells are not shown.

2—Modelling the Fracture Network

In order to take into account the role of the fracture network in the simulation of flows within the reservoir, it is necessary to associate with each of these elementary volumes (cells of the reservoir model) a modelling of the fractures.

Thus, one object of the invention relates to a method for constructing a representation of a fluid reservoir traversed by a fracture network and by at least one well. This method comprises discretizing the reservoir into a set of cells (stage 1 described above). The method then comprises the following stages:

a. characterizing the fractures by statistical parameters (PSF) from reservoir observations;

b. determining from these statistical parameters (PSF) an equivalent permeability tensor and an average opening of the fractures, from which an image representative of the fracture network delimiting porous blocks and fractures is constructed;

c. determining from the tensor a direction of flow of the fluid around the well;

d. defining around the well a first elliptical boundary zone centered on the well and containing the well and at least a second elliptical boundary zone centered on the well within an inner boundary merging with the elliptical boundary of the first zone with the zones being oriented in the direction of flow of the fluid;

e. simplifying the image representative of the fracture network in each cell belonging to at least one zone;

f. repeating b) while modifying the statistical parameters (PSF) to minimize the difference between the well test result and the well test simulation result from the simplified image; and g. associating with each cell at least one equivalent permeability value and a fracture average opening value with these values being determined from the modified statistical parameters (PSF).

These stages are described in detail hereafter.

Fracture Characterization

The statistical reservoir characterization is based upon carrying out direct and indirect reservoir observations (OF). This characterization uses 1) well cores extracted from the reservoir, on which a statistical study of the intersected fractures is performed, 2) outcrops which are characteristic of the reservoir which has the advantage of providing a large-scale view of the fracture network, and 3) seismic images allowing the identification of major geological events.

These measurements allow characterizing the fractures by statistical parameters (PSF) which are their respective density, length, orientation, inclination and opening, and their distribution within the reservoir.

At the end of this fracture characterization stage, statistical parameters (PSF) are obtained describing the fracture networks from which realistic images of the real (geological) networks can be reconstructed (generated) on the scale of each cell of the reservoir model considered (simulation domain).

The goal of characterization and modelling of the reservoir fracture network is to provide a fracture model validated on the local flows around the wells. This fracture model is then extended to the reservoir scale in order to achieve production simulations. Flow properties are therefore associated with each cell of the reservoir model (MR) (permeability tensor, porosity) of the two media (fracture and matrix).

These properties can be determined either directly from the statistical parameters (PSF) describing the fracture networks, or from a discrete fracture network (DFN) obtained from the statistical parameters (PSF).

Figure 3:
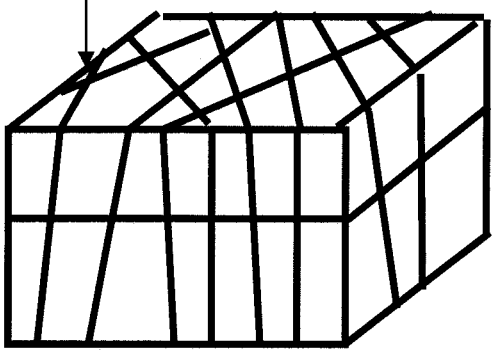
FIG. 3 illustrates an initial discrete fracture network (DFN)

Constructing a Discrete Fracture Network (DFN)·FIGS. 2 and 3

Starting from a reservoir model of the reservoir being studied, a detailed representation (DFN) of the internal complexity of the fracture network which is as accurate as possible in relation to the direct and indirect reservoir observations, is associated with each cell. FIG. 2 illustrates a realization of a fracture/fault network on the scale of a reservoir. Each cell of the reservoir model thus represents a discrete fracture network delimiting a set of porous matrix blocks, of irregular shape and size, delimited by fractures. Such an image is shown in FIG. 3. This discrete fracture network constitutes an image representative of the real fracture network delimiting the matrix blocks.

Constructing a discrete fracture network in each cell of a reservoir model can be achieved using known modelling softwares, such as the FRACAFlow® software (IFP, France). These softwares use the statistical parameters determined in the fracture characterization stage.

The next stage determines the flow properties of the initial fractures ($C_f$, e) and then calibrates these properties by well test simulations on discrete local flow models obtained from the realistic image of the real (geological) fracture network on the reservoir scale. Although it covers a limited area (drainage area) around the well only, such a well test simulation model still comprises a very large number of calculation nodes if the fracture network is dense. Consequently, the size of the systems to be solved and/or the computation time often remain prohibitive, hence the necessity to use a fracture network simplification procedure.

Figure 5:
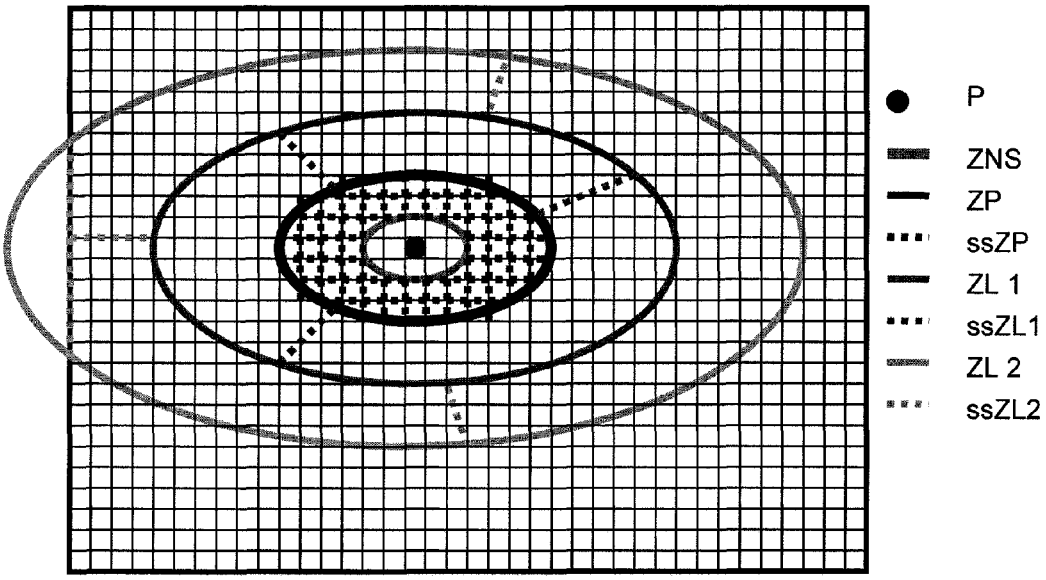
FIG. 5 illustrates the creation of zones and sub-zones necessary for simplification of the equivalent fracture network (RFE)

Fracture Network Simplification—FIG. 5

Because of its extreme geometrical complexity, the fracture network obtained in the previous stage, representative of the real fractured reservoir, cannot be used to simulate, that is reproduce and/or predict, the local flows around the well.

In order to overcome this obstacle, the method according to the invention uses a procedure based on the division of the simulation domain (that is the reservoir model) into at least three types of zone around each well (FIG. 5):

- A first zone wherein no fracture network simplification is performed. This zone contains the well and its center. It is denoted by ZNS (non-simplified zone);
- A second zone which is in contact with the first zone, wherein a moderate simplification of the fracture network is performed. This zone is denoted by ZP (zone to be simplified close to the well);
- A third zone, in contact with the second zone, wherein a significant simplification of the fracture network is performed. This zone is denoted by ZL (zone at a distance from the well).

The invention is not limited to the definition of three zones. It is also possible to divide the domain into n zones in which the simplification of the network increases from zone 1 (ZNS) to zone n (the furthest from the well). It is thus possible to create a zone ZNS, n1 zones of type ZP and n2 zones of type ZL.

Constructing the Zones—FIG. 5

The goal of fracture network modelling is to simulate the well flow responses (transient or pseudo-permanent flow tests, interferences, flow measurement, etc.). It consists for example in simulating the oil production via each well drilled through the reservoir.

For each well, each zone is defined according to an exterior boundary forming an ellipse centered on the well. The three zones are thus concentric and with elliptical boundaries. The two simplified zones ZP and ZL have inner boundaries corresponding to the outer boundary of the respective zones ZNS and ZP. Except for the non-simplified zone, the zones thus are elliptical rings centered on the well. To construct each zone, it is a must to define:

- the orientation of the ellipse, that is the direction of the major axis of the ellipse (perpendicular to the direction of the minor axis); and
- the dimensions of the ellipse, that is the length of the axes.

Their orientation is determined by the directions of flow determined from a calculation of equivalent permeabilities on zone ZNS. This type of equivalent permeability calculation is well known. It is possible to use, for example, the numerical method of calculating fractured media equivalent properties, implemented in the FracaFlow software (IFP Energies nouvelles, France) and described hereafter.

According to this method, a permeability tensor representative of the flow properties of the discretized fracture network (DFN) can be obtained via two upscaling methods.

The first method which is an analytical method referred to as local analytical upscaling, is based on an analytical approach described in the following documents:

Oda M. (1985): Permeability Tensor for Discontinuous Rock Masses, Geotechnique Vol 35, 483-495; and Patent application EP 2 037 080.

It affords the advantage of being very fast. Its range of application is however limited to well connected fracture networks. In the opposite case, major errors on the permeability tensor can be observed.

The second method which is a numerical method referred to as local numerical upscaling, is described in the following documents:

Bourbiaux, B., et al., 1998, *"A Rapid and Efficient Methodology to Convert Fractured Reservoir Images into a Dual-Porosity Model"*, Oil & Gas Science and Technology, Vol. 53, No. 6, November-December 1998, 785-799.

French Patent 2.757.947, corresponding to U.S. Pat. No. 6,023,656 for equivalent permeabilities, and French Patent 2,757,957, corresponding to U.S. Pat. No. 6,064,944, for equivalent block dimensions.

It is based on the numerical solution of the equations of flow on a discrete grid of the fracture network for various boundary conditions of the computation block considered. The equivalent permeability tensor is obtained by identification of the ratios between flow rate and pressure drop at the boundaries of the computation block. This approach, which is more expensive than the previous one, has the advantage of characterizing a given network (even weakly connected well).

According to an embodiment, it is possible to select one or the other of the two previous methods to optimize the accuracy and speed of the computations, by applying the method described in EP Patent Application 2,037,080, based on the computation of a connectivity index.

This technique allows, in a preliminary stage, determination of the permeability tensors of some cells of the reservoir model surrounding the well, and is considered to be representative of the flow of ZNS. Diagonalization of these permeability tensors provides the eigenvectors oriented in the principal directions of flow that are being sought. It is then possible to orient the elliptical domain ZNS centered on the well along the semi-major axis of the permeability ellipse determined by the preliminary computations.

Then, in order to define the dimensions of the ellipse, an aspect ratio is defined for this ellipse, as well as a distance between concentric ellipsis (distance between the inner and outer elliptical boundaries of a given concentric ring):

- aspect ratio of the ellipsis. By denoting by $L_{max}$ the half-length of the major axis of the ellipse, and by $L_{min}$ the half-length of the minor axis of the ellipse, this aspect ratio is defined by $L_{max}/L_{min}$. It should not be fixed arbitrarily but, and to the contrary, it should be selected to reproduce the flow anisotropy. The calculated equivalent permeability tensor can be used to determine the orientation. If the principal values of this tensor are denoted by $K_{min}$ and $K_{max}$, then the ellipsis are oriented in the principal permeability directions with an aspect ratio $L_{max}/L_{min}$ equal to the square root of ratio $K_{max}/K_{min}$:

$$\frac{L_{max}}{L_{min}} = \sqrt{\frac{K_{max}}{K_{min}}}$$

which is a distance between concentric ellipsis (boundaries between zones).

A dimensioning criterion in accordance with a modelling accuracy uniformly distributed over the simulation domain sets the half-lengths of the major axis $L_{max}$ (or of the minor axis $L_{min}$) of 2 successive ellipsis i+1 and i at values in geometric progression of constant ratio r (equal to 2 for example), that is:

$$\frac{L_{max(i+1)}}{L_{max(i)}} = \frac{L_{min(i+1)}}{L_{min(i)}} = r,$$

for any I, with initialization to the value $L_{max0}$ of the non-simplified zone. This rule allows giving an equal weight to each zone I (i=1 to n) in terms of pressure difference observed in each ring under permanent flow regime conditions.

Once this global dimensioning is achieved, the sub-zone delimitation and simplification procedures are implemented which are also based on the methods of calculating the equivalent properties of fractured media.

Constructing Sub-Zones in Each Zone—FIG. 5

Each zone, except zone ZNS, is then subdivided into sub-zones (ssZP, ssZL1, ssZL2) within which simplification of the fracture network is performed. The number of sub-zones per zone depends on the type of the zone (ZNS, ZP or ZL) and on the heterogeneity thereof. Thus:

Zone ZNS is to be kept intact (non simplified); no sub-zone is created therein,

The zones to be simplified that are the closest to a well (ZP type zones) require particular attention. In order to correctly model the local variations of the flow properties in this zone, zones ZP are divided into a number of sub-zones equal to the number of blocks of cells present in zones ZP. The term "block of cells" is used to designate a "stack" of vertical cells (of CPG type (Corner Point Grid) for example) of the reservoir model, delimited by the same sub-vertical upright poles. They are therefore no equivalent blocks;

The zones to be simplified that are the furthest from a well (ZL type zones) are concentric elliptical rings that cover increasingly large surfaces as the distance from the well increases. Being further away from the wells, it is acceptable to be less accurate regarding heterogeneities detection than in the case of ZP type zones. The heterogeneity of the flow properties of a ZL type zone remains however the principal factor controlling the subdivision into sub-zones. To sample a ZL type zone, an angular scan centered on the well is performed on the outer elliptical limit separating the zone ZL being considered from its outer neighbor. For every degree, a block of cells is selected. Thus, zone ZL is characterized by at most 360 blocks. For each block, the equivalent fracture permeability tensor is calculated. This tensor allows characterizing the dynamic properties of the fracture network of the block being studied. The permeability values and the flow orientation obtained are then compared among neighboring blocks. If the properties of two neighboring blocks are close, these two blocks are considered to belong to the same sub-zone. In the opposite case (20% difference on the principal permeability values or 10 degree difference on the principal permeability directions for example), the two blocks are assigned to different sub-zones. The outer limit of the zone ZL is considered is divided into arcs of elliptical shape (FIG. 1). The sub-zones are then obtained by connecting the end points of each arc to the center (well) of the ellipse (dotted lines in FIG. 5). Each sub-zone is thus defined as the area contained between the intra-zone radial partition (dotted lines) and the inter-zone elliptical limits (full line).

As mentioned above, the delimitation of the sub-zones (limit points of the inter-zone elliptical boundary arcs) is based on the comparison of the equivalent permeabilities calculated on the "neighboring" blocks marking these arcs. The analytical method of computing the equivalent permeabilities is preferably used because the goal is, in this case, to determine whether a block has the same dynamic behavior as the neighboring block. Although, for a weakly connected network, the analytical approach provides erroneous results, errors are systematic, which are similar from one block to the next, which allows comparison of the results between blocks which clearly does not require a high accuracy considering the simple zone definition objective. Thus, the analytical approach is totally justified, with the considerable advantage of enabling must faster calculations, thus guaranteeing practical feasibility.

Simplifying the Fracture Network in the Sub-Zones (RFE, RFES)

Once the zones ARE divided into sub-zones, the upscaling calculations allow replacement of the fracture network of these sub-zones by a simplified network having the same flow properties as the initial network. In this case, and unlike what is written above, the calculation of the equivalent fracture permeability tensor has to be as accurate as possible.

In order to make the most of the advantages afforded by the two upscaling methods, the permeability tensor is determined by one or the other of these two methods for example, according to the selection procedure described in document EP Patent 2,037,080, based on the value of the connectivity index of the fracture network. This index, which is representative of the ratio between the number of intersections between fractures and the number of fractures, is calculated for each unit of the block being considered (that is 2D). Its value allows considering the network as very well connected, weakly/badly connected or non-connected. The upscaling method is then selected as follows Delorme, M., Atfeh, B., Alken, V. and Bourbiaux, B. 2008, Upscaling Improvement for Heterogeneous Fractured Reservoir Using a Geostatistical Connectivity Index, edited in Geostatistics 2008, VIII International Geostatistics Congress, Santiago, Chile:

A well-connected network in this case is characterized by a connectivity index close to or exceeding 3 (at least 3 intersections per fracture of the network on average). The analytical upscaling method is selected because its accuracy is guaranteed considering the good connectivity of the network with the essential additional advantage of fastness;

A weakly/badly-connected network in this case is when the connectivity index ranges between 1 and 3 (which corresponds to a number of fracture intersections ranging between one and three times the number of fractures), and the numerical upscaling method is selected to reliably calculate the permeability tensor;

When the network is very poorly or even not connected, which occurs when number of intersections is close to or lower than the number of fractures). The original fractures (which are few) are kept. That is, the sub-zone in question is not simplified.

Figure 4:
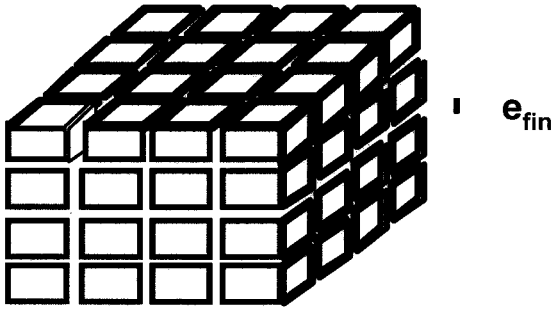
FIG. 4 illustrates a so-called Warren and Root equivalent fracture network (RFE)

Once these equivalent permeability calculations are carried out for each sub-zone, the other equivalent flow parameters characterizing the simplified sub-zones are readily determined according to the following methods and equivalences:

Calculation of a first equivalent network (so-called Warren and Root parallelepipedic network), which is referred to as "fine", directly resulting from the method of French Patent 2,757,957 corresponding to U.S. Pat. No. 6,064,944. This network (FIG. 4) is characterized by spacings of fractures $s_1^{fin}$, $s_2^{fin}$ in the 2 orthogonal directions of principal permeability 1 and 2 defining the fracture network.

An additional parameter, the opening of the fractures ($e^{fin}$), characterizes the fractures of this fine network. The value of the fracture openings is in practice nearly always negligible in relation to the fracture spacing. This hypothesis is taken into account in the following formulas, where the same opening value is assumed for the 2 fracture families. Considering the equality of porosities of the initial network DFN ( $_f$) and of the fine equivalent network, $e^{fin}$ is deduced from the fracture volume of the initial network DFN, $V_f^{init}$, and from the total rock volume $V_T$ as follows:

$$e^{fin} = \frac{1}{\left(\frac{1}{s_1^{fin}} + \frac{1}{s_2^{fin}}\right)} \frac{V_f^{init}}{V_T} = \frac{1}{\left(\frac{1}{s_1^{fin}} + \frac{1}{s_2^{fin}}\right)} \phi_f$$

As a matter of interest, the principal equivalent fracture permeabilities obtained from the aforementioned calculations are $k_1 = k_{eq}^{max}$ and $k_2 = k_{eq}^{Min}$ in the principal directions 1 and 2. The conductivities of the fractures of the fine equivalent network, $C_{f1}^{fin}$ and $C_{f2}^{fin}$, in these two directions of flow are deduced by writing the conservation of the flows per unit area of fractured medium:

$C_{f1}^{fin} = s_2^{fin} \cdot k_1$ and $C_{f2}^{fin} = s_1^{fin} \cdot k_2$

Finally, the matrix medium between fractures has a permeability $k_m^{fin}$.

Replacement of this fine network (FIG. 4) by the so-called "coarse" equivalent network (FIG. 6) comprises more spaced-out fractures to increase the degree of simplification with a view to later flow simulations. The geometric and flow properties of this coarse network are as follows:

fracture spacings $s_1^{gros}$ and $s_2^{gros}$ such that:

$s_1^{gros} = G \cdot s_1^{fin}$ $s_2^{gros} = G \cdot s_2^{fin}$, where G is a (fracture spacing) magnification coefficient of the network whose value is left to the user's discretion, with however an upper limit $G_{max\text{-}zone}$ that should not be exceeded to guarantee sufficient connectivity between simplified and non-simplified zones:

$G < G_{max\text{-}zone}$ where $G_{max\text{-}zone}$ is such that $\mathrm{Max}(s_1^{gros}, s_2^{gros}) <$ (minimum lateral dimension of the sub-zone)/6

Thus:

$$G_{max-zone} = \frac{DLM}{6 \cdot \mathrm{Max}(s_1^{fin}, s_2^{fin})}$$

with:

DLM is a minimum lateral dimension of the given sub-zone;

$s_1^{fin}$ and $s_2^{fin}$ are fracture spacings in the so-called Warren and Root representation.

fracture conductivities $C_{f1}^{gros}$ and $C_{f2}^{gros}$ have values allow keeping the flows per unit area of fractured medium, that is also the equivalent permeabilities, that is:

$C_{f1}^{gros} = s_2^{gros} \cdot k_1$ and $C_{f2}^{gros} = s_1^{gros} \cdot k_2$, or, knowing that $C_{f1}^{fin} = s_2^{fin} \cdot k_1$ and $C_{f2}^{fin} = s_1^{fin} \cdot k_2$, $C_{f1}^{gros} = G \cdot C_{f1}^{fin}$ and $C_{f2}^{gros} = G \cdot C_{f2}^{fin}$ A fracture opening $e^{gros}$ allows again keeping the fracture porosity $\phi_f$ of the initial network which is equal to that of the coarse equivalent network:

$$\phi_f = e^{gros} \cdot (1/s_1^{gros} + 1/s_2^{gros}) = e^{fin} \cdot (1/s_1^{fin} + 1/s_2^{fin})$$

$$\text{hence: } e^{gros} = e^{fin} \frac{\frac{1}{s_1^{fin}} + \frac{1}{s_2^{fin}}}{\frac{1}{s_1^{gros}} + \frac{1}{s_2^{gros}}} = G \cdot e^{fin}$$

a matrix permeability $k_m^{gros}$ keeps the value of the matrix-fracture exchange parameter:

$$\lambda_{fin} = r_w^2 \frac{k_m^{fin}}{k_f^{fin}} \left( \frac{\alpha}{s_1^{fin2}} + \frac{\alpha}{s_2^{fin2}} \right) = \lambda_{grossier} = r_w^2 \frac{k_m^{gros}}{k_f^{gros}} \left( \frac{\alpha}{s_1^{gros2}} + \frac{\alpha}{s_2^{gros2}} \right)$$

where $\alpha$ is a constant and where the fracture equivalent permeabilities of the fine and coarse networks are equal and denoted by $k_f^{fin}$ and $k_f^{gros}$, That is:

$$k_m^{gros} = k_m^{fin} \frac{\frac{1}{S_1^{fin2}} + \frac{1}{S_2^{fin2}}}{\frac{1}{S_1^{gros2}} + \frac{1}{S_2^{gros2}}} = G^2 k_m^{fin}$$

Finally, once this fine network coarse network→equivalence operation achieved for each sub-zone (or "block" of ZP), the fractures of the simplified networks obtained are extended outside the limits of sub-zones (or "blocks") in order to guarantee sufficient partial "covering" and therefore sufficient horizontal connectivity of the simplified networks of neighboring sub-zones (or "blocks" of ZP). Therefore, by following a test-proven procedure, the fractures of the simplified network can thus be extended by a length equal to 60% of the maximum spacing ($s_1^{gros}$,$s_2^{gros}$) of the fractures of this network.

Figure 6:
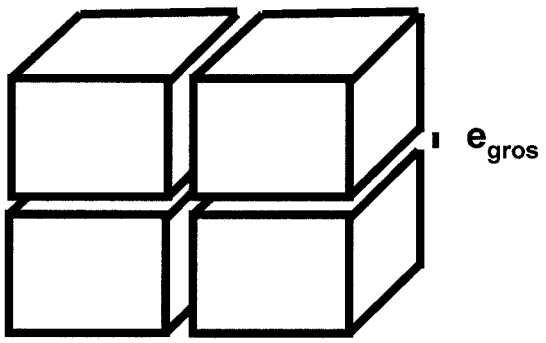
FIG. 6 illustrates a simplified equivalent fracture network (RFES) according to the invention.

Such an image is represented in FIG. 6.

Calibration of the Flow Properties of the Fractures

The next stage is the calibration of the flow properties of the fractures (fracture conductivity and opening), locally around the wells. This requires a well test simulation. According to the invention, this well test simulation is performed on the simplified flow models (FIG. 6).

This type of calibration is well known. The method described in French Patent 2,787,219 can for example be used. The flow responses of some wells (transient or pseudo-permanent flow tests, interferences, flow rate measurement, etc.) are simulated on these models extracted from the geological model giving a discrete (realistic) representation of the fractures supplying these wells. The simulation result is then compared with the real measurements performed in the wells. If the results differ, the statistical parameters (PSF) describing the fracture networks are modified, then the flow properties of the initial fractures are redetermined and a new simulation is carried out. The operation is repeated until the simulation results and the measurements agree.

The results of these simulations allow calibration (estimation) of the geometry and the flow properties of the fractures, such as the conductivities of the fracture networks of the reservoir being studied and the openings.

3—Simulation of the Fluid Flows (SIM) and Optimization of the Reservoir Production Conditions (OPT)

At this stage, the reservoir engineer has all the data required to construct the flow model on the reservoir scale. In fact, fractured reservoir simulations often adopt the "double-porosity" approach proposed for example by Warren J. E. et al. in "The Behavior of Naturally Fractured Reservoirs", SPE Journal (September 1963) at pages 245-255, according to which any elementary volume (cell of the reservoir model) of the fractured reservoir is modelled in a form of a set of identical parallelepipedic blocks, referred to as equivalent blocks, delimited by an orthogonal system of continuous uniform fractures oriented in the principal directions of flow. The fluid flow on the reservoir scale occurs through the fractures only, and fluid exchanges take place locally between the fractures and the matrix blocks. The reservoir engineer can for example use the methods described in the following documents, applied to the entire reservoir this time: French Patent 2,757,947 corresponding to U.S. Pat. No. 6,023,656 and French Patent 2,757,957 corresponding to U.S. Pat. No. 6,064,944, and EP Patent 2,037,080. These methods allow calculation of the equivalent fracture permeabilities and the equivalent block dimensions for each cell of the reservoir model.

The reservoir engineer chooses a production process, for example the waterflooding recovery process, for which the optimum implementation scenario remains to be specified for the field being considered. The definition of an optimum waterflooding scenario is for example the setting of the number and the location (position and spacing) of the injector and producer wells in order to best account for the impact of the fractures on the progression of the fluids within the reservoir.

According to the scenario being selected, that is the double-medium representation of the reservoir and to the formula relating the mass and/or energy exchange flow to the matrix-fracture potential difference, it is then possible to simulate the expected hydrocarbon production by means of the flow simulator (software) referred to as double-medium simulator.

At any time t of the simulated production, from input data E(t) (fixed or simulated-time varying data) and from the formula relating exchange flow (f) to potential difference ($\Delta\Phi$), the simulator solves all the equations specific to each cell and each one of the two grids of the model (equations involving the matrix-fracture exchange formula described above), and it thus delivers the values of solution to the unknowns S(t) (saturations, pressures, concentrations, temperature, etc.) at this time t. This solution provides knowledge of the amounts of oil produced and of the state of the reservoir (pressure distribution, saturations, etc.) at the time being considered.

4—Optimized Reservoir Development (EXPLO)

Selecting various scenarios characterized, for example, by various respective sites for the injector and producer wells, and simulating the hydrocarbon production for each one according to stage 3, enables selection of the scenario allowing the production of the fractured reservoir being considered to be optimized according to the technico-economic selected criteria.

Then the reservoir is developed according to this scenario allowing the reservoir production to be optimized.

The invention claimed is:

1. A method for optimizing the development of a fluid reservoir traversed by a fracture network and by at least one well, wherein a representation of the fluid reservoir is constructed, the reservoir is discretized into a set of cells and the fractures are characterized by statistical parameters from observations of the reservoir, comprising:

a) determining from the statistical parameters an equivalent permeability tensor and an average opening for the fractures from which an image representative of the fracture network delimiting porous blocks and fractures is constructed;

b) determining from the tensor a direction of flow of the fluid around the well;

c) defining around the well a first elliptical boundary zone centered on the well and containing the well and at least a second elliptical boundary zone centered on the well which forms an elliptical ring with the elliptical boundary of the first zone with the at least a second elliptical zone being oriented in the direction of flow of the fluid;

d) simplifying the image representative of the fracture network in a different manner in each of the zones;

e) using the simplified image to construct a representation of the fluid reservoir; and f) using the representation of the fluid reservoir and a flow simulator programmed with software executed by a computer to optimize the development of the fluid reservoir.

2. A method as claimed in claim 1, wherein the statistical parameters are selected from among the parameters: fracture density, fracture length, fracture orientation, fracture inclination, fracture opening and fracture distribution within the reservoir.

3. A method as claimed in claim 2, wherein an aspect ratio is determined for each zone which is defined from lengths of axes of an ellipse making up the boundary of each zone to reproduce a flow anisotropy around the well with the zones being constructed in accordance with the aspect ratio.

4. A method as claimed in claim 2, wherein a distance is defined between boundaries between the zones to give equal weight to each zone in terms of a pressure difference recorded in each zone under permanent flow conditions.

5. A method as claimed in claim 2, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

6. A method as claimed in claim 3, wherein the aspect ratio is determined by values of the permeability tensor.

7. A method as claimed in claim 3, wherein a distance is defined between boundaries between the zones to give equal weight to each zone in terms of a pressure difference recorded in each zone under permanent flow conditions.

8. A method as claimed in claim 4, wherein the distance is defined by setting lengths of one of two axes of two successive ellipsis at values in geometric progression of a constant ratio.

9. A method as claimed in claim 6, wherein a distance is defined between boundaries between the zones to give equal weight to each zone in terms of a pressure difference recorded in each zone under permanent flow conditions.

10. A method as claimed in claim 7, wherein the distance is defined by setting lengths of one of two axes of two successive ellipsis at values in geometric progression of a constant ratio.

11. A method as claimed in claim 9, wherein the distance is defined by setting lengths of one of two axes of two successive ellipsis at values in geometric progression of a constant ratio.

12. A method as claimed in claim 1, wherein an aspect ratio is determined for each zone which is defined from lengths of axes of an ellipse making up the boundary of each zone to reproduce a flow anisotropy around the well with the zones being constructed in accordance with the aspect ratio.

13. A method as claimed in claim 12, wherein the aspect ratio is determined by values of the permeability tensor.

14. A method as claimed in claim 12, wherein a distance is defined between boundaries between the zones to give equal weight to each zone in terms of a pressure difference recorded in each zone under permanent flow conditions.

15. A method as claimed in claim 12, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

16. A method as claimed in claim 13, wherein a distance is defined between boundaries between the zones to give equal weight to each zone in terms of a pressure difference recorded in each zone under permanent flow conditions.

17. A method as claimed in claim 13, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

18. A method as claimed in claim 14, wherein the distance is defined by setting lengths of one of two axes of two successive ellipsis at values in geometric progression of a constant ratio.

19. A method as claimed in claim 16, wherein the distance is defined by setting lengths of one of two axes of two successive ellipsis at values in geometric progression of a constant ratio.

20. A method as claimed in claim 1, wherein a distance is defined between boundaries between the zones to give equal weight to each zone in terms of a pressure difference recorded in each zone under permanent flow conditions.

21. A method as claimed in claim 20, wherein the distance is defined by setting lengths of one of two axes of two successive ellipsis values in geometric progression of a constant ratio.

22. A method as claimed in claim 20, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

23. A method as claimed in claim 21, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

24. A method as claimed in claim 1, wherein three zones are constructed with a first zone containing the well with no simplification of the image being provided, a second zone is constructed in contact with the first zone wherein a first simplification of the image is carried out and a third zone is constructed in contact with the second zone wherein a second simplification of the image is carried out with the second simplification being more significant than the first simplification.

25. A method as claimed in claim 24, wherein the second and third zones are divided into sub-zones by the steps:

dividing the second zone into a number of sub-zones equal in number to a number of blocks of cells present in the second zone with a block of cells designating a vertical stack of cells; and dividing the third zone by the steps of dividing every degree a boundary of the third zone with each degree defining 360 arcs, defining a sub-zone by connecting end points of each of the arcs to a center of an ellipse forming the boundary, for each of the sub-zones, calculating an equivalent fracture permeability tensor from which an orientation of the flows in the sub-zone is determined, comparing equivalent fracture permeability values and flow orientation between neighboring sub-zones, and grouping neighboring sub-zones together into a single sub-zone when a difference between the permeability values is below a first threshold and when a difference between the flow orientations is below a second threshold.

26. A method as claimed in claim 24, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

27. A method as claimed in claim 25 wherein, for a given sub-zone, value Gmax-zone is equal to:

$$G_{max-zone} = \frac{DLM}{6 \cdot \mathrm{Max}\left(s_1^{fin}, s_2^{fin}\right)}$$

with:

DLM being a minimum lateral dimension of the given sub-zone; and $s_1^{fin}$, $s_2^{fin}$ being fracture spacings in the Warren and Root representation.

28. A method as claimed in claim 25, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

29. A method as claimed in claim 1, wherein the image is simplified by the steps:

constructing a fracture network equivalent to the image, by a Warren and Root representation wherein the network has fracture spacings in two orthogonal directions of principal permeability, by a fracture opening parameter, by fracture conductivities and a permeability kmfin of a matrix medium between fractures;

simplifying the equivalent fracture network by a network fracture spacing coefficient whose value is less than a value Gmax-zone defined for each of the zones to guarantee connectivity between simplified zones and non-simplified zones.

30. A method as claimed in claim 29, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

31. A method as claimed in claim 1, comprising:

repeating a) while modifying the statistical parameters to minimize a difference between a well test result and a well test simulation result from the simplified image;

associating with each one of the cells at least one equivalent permeability value and an average opening value for the fractures with the values being determined from the modified statistical parameters;

simulating fluid flows in the reservoir by a flow simulator equivalent permeability values and average opening values of the fractures associated with each of the cells;

selecting a production scenario optimizing the reservoir production by the fluid flow simulation; and developing the reservoir according to the scenario to optimize reservoir production.

* * * * *